US005334409A

United States Patent [19]

Sohn et al.

[11] Patent Number: 5,334,409

[45] Date of Patent: Aug. 2, 1994

[54] CATHODE RAY TUBE AND PROCESS FOR PRODUCING SAME

[75] Inventors: Chang-min Sohn; Su-min Jeong, both of Suwon, Rep. of Korea

[73] Assignee: Samsung Electron Devices Co., Ltd., Kyungki, Rep. of Korea

[21] Appl. No.: 909,669

[22] Filed: Jul. 7, 1992

[30] Foreign Application Priority Data

Jul. 10, 1991 [KR] Rep. of Korea ..... 91-11707
Jul. 11, 1991 [KR] Rep. of Korea ..... 91-11782

[51] Int. Cl.[5] ..... B05D 5/06

[52] U.S. Cl. ..... 427/64; 427/68; 427/108; 427/226; 427/240; 427/397.7

[58] Field of Search ..... 427/64, 68, 240, 226, 427/108, 397.7

[56] References Cited

U.S. PATENT DOCUMENTS 4,873,120 10/1989 Itou et al. ..... 427/64
4,945,282 7/1990 Kawamura et al. ..... 313/479
4,965,096 10/1990 Deal et al. ..... 427/64

FOREIGN PATENT DOCUMENTS 61-118932 6/1986 Japan .

*Primary Examiner*—Janyce Bell
*Attorney, Agent, or Firm*—Leydig, Voit & Mayer

[57] ABSTRACT

A cathode ray tube having an antistatic and non-glare coating with a controlled and uniform degree of unevenness, can be produced by the process which comprises the steps of mixing an alcohol solution of an acid and a partially hydrolyzed alkylsilicate monomer with an amount of water being of at least four times greater than the number of moles of the alkylsilicate; applying the mixed solution to the outer surface of the panel by spin coating; followed by heating the resulting coating to a temperature in the range of 150° to 200° C. to form an antistatic and non-glare coating.

12 Claims, 1 Drawing Sheet

CATHODE RAY TUBE AND PROCESS FOR PRODUCING SAME

BACKGROUND OF THE INVENTION

The present invention relates to a cathode ray tube and a process for producing the same, and more particularly to a process of forming an antistatic and non-glare coating on the outer surface of the panel of a cathode ray tube.

Glasses or plastics are widely used for display devices, such as cathode ray tubes and liquid crystal display devices. Due to the insulation property of these materials, an electrostatic charge is accumulated on the outer surface of the front panel during or after the operation of the devices. Thus, dust is attracted and accumulated on the outer surface, which deteriorates the luminance and contrast of the cathode ray tube. Also, if the outer surface of the cathode ray tube is touched, operators may be shocked by an electrostatic charge present on the panel's surface.

In addition, the front panel's outer surface is glossy and liable to strongly reflect external light, making it difficult to view images formed thereon.

Thus, various methods have been proposed to prevent these display panels from being electrically charged and reflecting external light.

In order to prevent the surfaces of the display panels from being charged, there are methods of forming a transparent electroconductive coating on the panel's outer surface. Such an electroconductive film is formed, for example, by applying an electroconductor solution and heating the coating, or by vacuum deposition or sputtering.

In order to prevent the reflection of external light, the glassy surface of the panel is etched with hydrofluoric acid to form minute irregularities, thereby imparting a reflection-inhibiting function. In recent years, an alcohol solution containing $Si(OR)_4$ is spray-coated on the outer surface of the panel to form numerous fine projections.

Japanese Laid-Open Publication No. 61-118932 discloses a cathode ray tube having an antistatic and non-glare coating in which an alcohol solution of $Si(OR)_4$ is spray-coated on the outer surface of a panel and heated at 150° C. or less, to form a non-glare surface of $SiO_2$ film having silanol groups. Since the heating temperature is relatively low, some silanol groups (≡Si—OH) remain in the siloxane structure (≡Si—O—Si≡), and the hygroscopic nature of the —OH group endows the film with antistatic properties.

U.S. Pat. No. 4,945,282 discloses a process for producing image display panels which comprises the step of: applying a suspension of fine particles of at least one of an electroconductive metal oxide ($SnO_2$, $In_2O_3$, $Sb_2O_3$) and hygroscopic metal salts in an alcoholic solution of alkoxysilane on the front surface of the panel, followed by heat treatment of the resulting coating to form an antistatic film. This process may further comprise the step of forming a thin non-glare film of $SiO_2$ on the antistatic film.

According to the method of spraying an alcohol solution of $Si(OR)_4$ and heating to form a non-glare coating of $SiO_2$ having minute projections or depressions, sprayed liquid particles are not uniformly deposited, that is, they are more thickly deposited toward the periphery of the object panel surface.

For that reason and others (such as heating conditions), it is difficult to create a uniform degree of unevenness throughout the panel's surface. Such inconsistent unevenness of the surface coating results in an irregular non-glare effect to the panel, which in turn will cause lower degrees of resolution.

SUMMARY OF THE INVENTION

It is an object of the present invention to provide a process for producing a cathode ray tube, wherein an antistatic and non-glare coating having a controlled and uniform degree of unevenness is formed on the outer surface of the panel.

It is another object of the present invention to provide a cathode ray tube produced by the above-mentioned process.

According to the present invention, there is provided a cathode ray tube and a process for producing the same comprising the steps of:

mixing an alcohol solution of at an acid and a partially hydrolyzed alkylsilicate monomer with an amount of water being at least four times greater than the number of moles of the alkylsilicate, applying the mixed solution to the outer surface of the panel by spin coating; and heating the resulting coating to a temperature in the range of 150° to 200° C. for 5 to 30 minutes to form an antistatic and non-glare coating.

Alkylsilicate monomer $Si(OR)_4$ needs an amount of water being at least the same number of moles as the alkoxy group, that is, at least four times its own number of moles to be hydrolyzed completely, and can be represented by:

$$Si(OR)_4+4H_2O \rightarrow Si(OH)_4+4ROH$$

By adding water in a quantity of 2 times or less than the moles of the alkylsilicate monomer to an alcohol solution of the alkylsilicate monomer containing an acid as a catalyst for facilitating the hydrolysis of alkylsilicate, a partially hydrolyzed alkylsilicate monomer is prepared, and can be represented by:

$$Si(OR)_4+H_2O \rightarrow Si(OR)_3(OH)+ROH$$

$$Si(OR)_3(OH)+H_2O=Si(OR)_2(OH)_2+ROH$$

An alcohol solution of the partially hydrolyzed alkylsilicate including a silanol group is mixed with an amount of water being of at least four times greater than the number of alkylsilicate moles, and acid. Then, the mixed solution is spin-coated on the outer surface of the panel, followed by heating to promote condensation of the silanol group, and can be represented by:

$$\equiv Si—OH+RO—Si\equiv \rightarrow \equiv Si—O—Si\equiv+ROH$$

$$\equiv Si—OH+HO—Si\equiv \rightarrow \equiv Si—O—Si\equiv+H_2O$$

By mixing more water than needed with the alkylsilicate, a network-like unevenness can be formed due to the difference of volatility between water and alcohol.

In addition, the scale of the network can be controlled by changing the revolution speed and duration of the spin-coating.

Instead of the partially hydrolyzed alkylsilicate monomer, an alkylsilicate polymer can be used interchangeably and obtains the same effect. The alkylsilicate polymer is desirably in the range of a dimer to a pentamer.

If an alkylsilicate hexamer or more is used, the solution mixed therewith tends to gel easily, and is not preferable.

An alcohol component of the alcohol solution of an alkylsilicate of the present invention may be at least one selected from a methanol, ethanol, isopropanol, and butanol. Although the term "alcohol solution" is used for convenience, at least one ketone, such as acetone, methylethylketone and methylisobutyl ketone may be included in the solution.

An inorganic acid, such as, hydrochloric acid, nitric acid, acetic acid or phosphoric acid is added to promote the hydrolysis of the alkylsilicate in the present invention. The amount of the acid used is preferably in the range of 0.001 to 0.1 moles per mole of the alkylsilicate to be hydrolyzed. Water must be added in the amount of four times or greater than the number of alkylsilicate moles, preferably, in the range of 5 to 20 moles per alkylsilicate mole.

The coating solution is applied to the outer surface of the panel of a cathode-ray tube by spin-coating, of which the revolution speed may be selected as needed. The resultant tube is heated at a temperature range of 150° to 200° C. for 5 to 30 minutes. At such a relatively low heating temperature, the silanol group generated by hydrolysis of the alkylsilicate remains in the siloxane structure, thereby making the coating antistatic to some extent. In addition, the outer surface of the panel coated with a controlled and uniform degree of unevenness has a non-glare effect.

To enhance the antistatic effect of the coating, the coating composition of the present invention may further contain a electroconductive metal salt, such as, a stannic chloride ($SnCl_4$).

DETAILED DESCRIPTION OF THE PREFERRED EMBODIMENT

Figure 1:
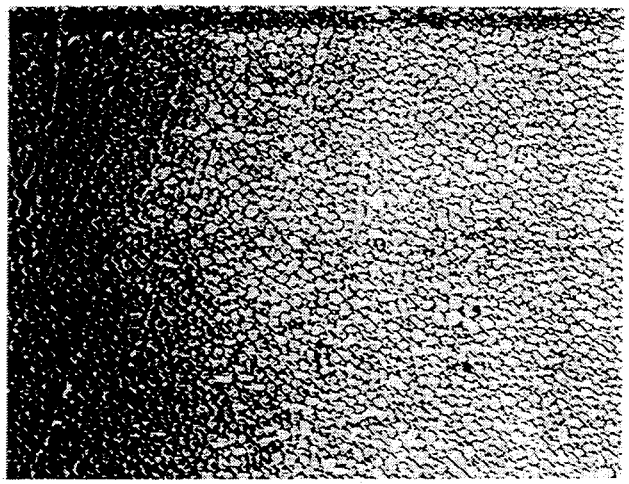
FIG. 1 is a photograph (400×) of the magnified outer surface of the panel of a cathode ray tube formed according to Example 1 of the present invention.

The present invention will be described in detail by way of the following examples which are merely representative and illustrative of the present invention but are in no way to be considered as limiting the invention to the specific examples.

EXAMPLE 1

An alcohol solution of an alkylsilicate polymer and an acid solution were prepared as in the following composition.

| | | |
|---|---|---|
| (1) | Alcohol solution of alkylsilicate polymer | |
| | ethylsilicate polymer* | 90 ml |
| | methanol | 1,000 ml |
| | isopropanol | 500 ml |
| | butanol | 100 ml |
| (2) | acid solution | |
| | hydrochloric acid | 0.5 ml |
| | water | 50 ml |

*"Ethyl Silicate 40" from Union Carbide Corporation was used as the ethylsilicate polymer.

100 ml of the alcohol solution of the ethylsilicate polymer (1) was mixed with 10 ml of the diluted HCl (2), and stirred for 5 minutes. The mixed solution was applied to the outer surface of the panel of a cathode ray tube by spin-coating with a speed of 200 rpm. The coated tube was heated at a temperature of 180° C. for 20 minutes to form an antistatic and non-glare coating on the outer surface of the panel. The surface coating obtained was photographed and shown in FIG. 1 under 400× magnification.

EXAMPLE 2

An alcohol solution of a partially hydrolyzed alkylsilicate monomer was prepared by mixing the following.

| | |
|---|---|
| ethylsilicate monomer* | 40 ml |
| methanol | 300 ml |
| ethanol | 200 ml |
| nitric acid | 0.1 ml |
| water | 7 ml |

*"Ethyl Silicate 28" was used as the ethylsilicate monomer.

40 ml of the alcohol solution of a partially hydrolyzed ethylsilicate monomer was mixed with 50 ml of isopropanol, 10 ml of butanol, and 10 ml to the acid solution (2) in Example 1, and stirred for 30 minutes. The mixed solution was applied to the outer surface of the panel of a cathode ray tube by spin-coating with a speed of 150 rpm. The coated tube was heated at a temperature of 180° C. for 20 minutes to form an antistatic and non-glare coating on the outer surface of the panel.

EXAMPLE 3

The same procedure as in Example 2 was repeated except that $SnCl_4$ was further added to the mixed solution. The obtained surface coating was photographed and shown in FIG. 2 under 400× magnification.

Figure 2:
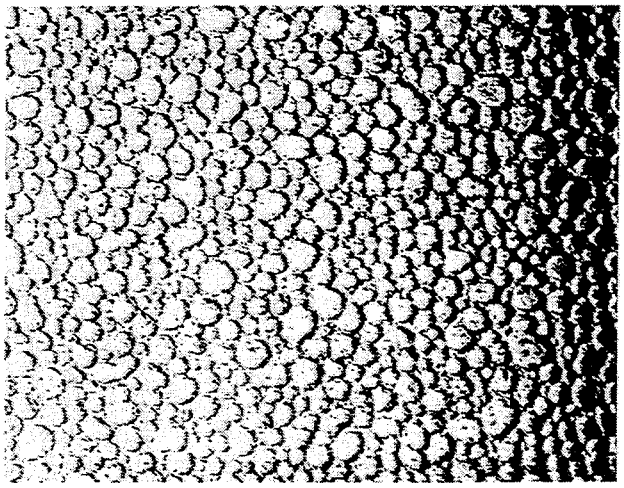
FIG. 2 is a photograph (400×) of the magnified outer surface of the panel of a cathode ray tube formed according to Example 3 of the present invention.
Figure 3:
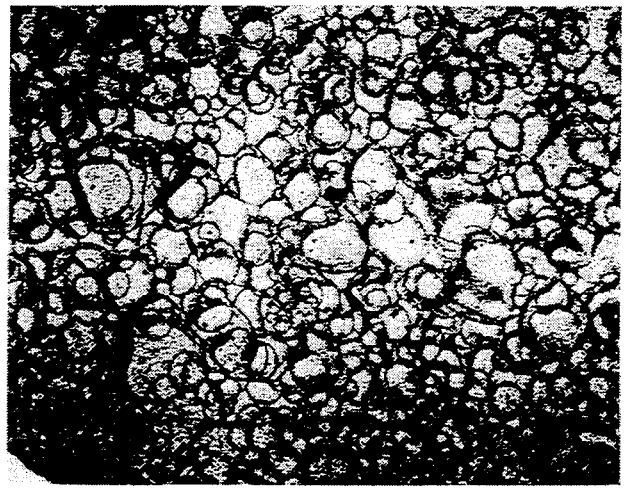
FIG. 3 PRIOR ART
FIG. 3 is a photograph (200×) of the magnified outer surface of the panel of a cathode ray tube formed according to a conventional process.

As shown in FIGS. 1 to 3, the antistatic and non-glare coating according to the present invention shows a controlled and uniform degree of unevenness, while the conventional one shows uncontrolled and irregular projections or depressions. Thus, the cathode ray tube of the present invention has a uniform non-glare effect. In addition, the surface resistivity of the coating according to the present invention is about $1\times10^9$ to $8.1\times10^{10}$ Ω cm, which is sufficient to give the coating an antistatic characteristic.

As will be apparent to those skilled in the art, various changes and modifications may be made to the process for producing a cathode ray tube of the present invention without departing from the spirit and scope of the invention as determined in the appended claims and their legal equivalents.

What is claimed is:

1. A process for producing a cathode ray tube comprising the steps of:

mixing an alcohol solution of an acid and a partially hydrolyzed alkylsilicate monomer with an amount of water being at least four times greater than the number of moles of said alkylsilicate;

applying the mixed solution to the outer surface of a panel by spin coating to form a coating thereon; and heating the resulting coating to a temperature in the range of 150° to 200° C. for 5 to 30 minutes to form an antistatic and non-glare coating.

2. A process as claimed in claim 1, wherein said partially hydrolyzed alkylsilicate monomer is prepared by adding an amount of water being of two times or less than the number of moles of said alkylsilicate monomer to an alcohol solution of said alkylsilicate monomer containing an acid.

3. A process as claimed in claim 1, wherein said alkylsilicate is ethylsilicate.

4. A process as claimed in claim 1, wherein said water is mixed in the ratio of 5 to 20 moles per mole of alkylsilicate.

5. A process as claimed in claim 1, wherein said acid is mixed in the ratio of 0.001 to 0.1 moles per mole of alkylsilicate.

6. A process as claimed in claim 1, wherein said alcohol solution further contains an electroconductive metal salt.

7. A process as claimed in claim 6, wherein said electroconductive metal salt is a stannic chloride.

8. A process as claimed in claim 1 wherein said acid is hydrochloric, acetic or phosphoric acid.

9. A process as claimed in claim 1 wherein said acid is hydrochloric acid.

10. A process as claimed in claim 1 wherein said alcohol includes at least two alcohols selected from the group consisting of methanol, ethanol, isopropanol and butanol.

11. A process as claimed in claim 1 wherein said alcohol solution further includes at least one ketone.

12. A process as claimed in claim 11 wherein said ketone is acetone, methyl ethyl ketone, or methyl isobutyl ketone.

* * * * *